United States Patent [19]

Sauter et al.

[11] Patent Number: 4,773,919

[45] Date of Patent: Sep. 27, 1988

[54] FIXED BED GASIFICATION PROCESS

[75] Inventors: Dieter Sauter, Nidderau; Udo Zentner, Darmstadt, both of Fed. Rep. of Germany

[73] Assignee: Metallgesellschaft AG, Frankfurt am Main, Fed. Rep. of Germany

[21] Appl. No.: 62,255

[22] Filed: Jun. 15, 1987

Related U.S. Application Data

[60] Continuation of Ser. No. 943,893, Dec. 17, 1986, abandoned, which is a division of Ser. No. 795,387, Nov. 6, 1985, abandoned.

[30] Foreign Application Priority Data

Nov. 15, 1984 [DE] Fed. Rep. of Germany ..... 3441757

[51] Int. Cl.[4] ..... C10J 3/02; C10J 3/08

[52] U.S. Cl. ..... 48/202; 44/16 A; 48/206; 48/210

[58] Field of Search ..... 44/16 A, 17, 26; 48/202, 206, 210, DIG. 2; 201/6

[56] References Cited

U.S. PATENT DOCUMENTS

| | | | |
|---|---|---|---|
| 1,913,121 | 6/1933 | Kern | 44/26 |
| 2,163,148 | 6/1939 | Linder | 48/DIG. 2 |
| 3,540,867 | 11/1970 | Baron et al. | 48/197 R |
| 3,692,505 | 9/1972 | Reichl | 48/206 |
| 3,762,886 | 10/1973 | Triska | 44/16 A |
| 4,111,665 | 9/1978 | Pasternak et al. | 201/6 |
| 4,167,398 | 9/1979 | Hughes et al. | 44/16 A |
| 4,239,500 | 12/1980 | Ratzeburg | 48/202 |
| 4,356,004 | 10/1982 | Richter | 48/210 |
| 4,608,059 | 8/1986 | Kupfer et al. | 48/210 |

FOREIGN PATENT DOCUMENTS

| | | |
|---|---|---|
| 2201278 | 7/1973 | Fed. Rep. of Germany . |
| 1391034 | 4/1975 | United Kingdom . |
| 1507905 | 4/1978 | United Kingdom . |
| 1508671 | 4/1978 | United Kingdom . |
| 1512677 | 6/1978 | United Kingdom . |

*Primary Examiner*—Barry S. Richman
*Assistant Examiner*—Joye L. Woodard
*Attorney, Agent, or Firm*—Sprung Horn Kramer & Woods

[57] ABSTRACT

Gasification is performed under pressures in the range from 5 bars to 150 bars with oxygen, steam and/or carbon dioxide as gasifying agents. Pellets are fed to the top of a fixed bed in the gasification reactor. The gasifying agents are introduced into the fixed bed from below. Mineral constituents are withdrawn as solid ash or liquid slag from the lower end of the fixed bed. The pellets are made from fine-grained hard coal which has a particle size below 1 mm and contains 3 to 10 wt. % of fines having particle sizes not in excess of 2 micrometers and 70 to 80 wt. % of particles not in excess of a fraction not in excess of 63 micrometers. The fine-grained hard coal is mixed with bentonite to obtain a mixture which contains 1 to 8 wt. % bentonite. With an addition of water, the mixture is shaped to form pellets which contain 15 to 25 wt. % water. The pellets are fed in an undried, moist, plastically deformable state to the top of the fixed bed.

8 Claims, 1 Drawing Sheet

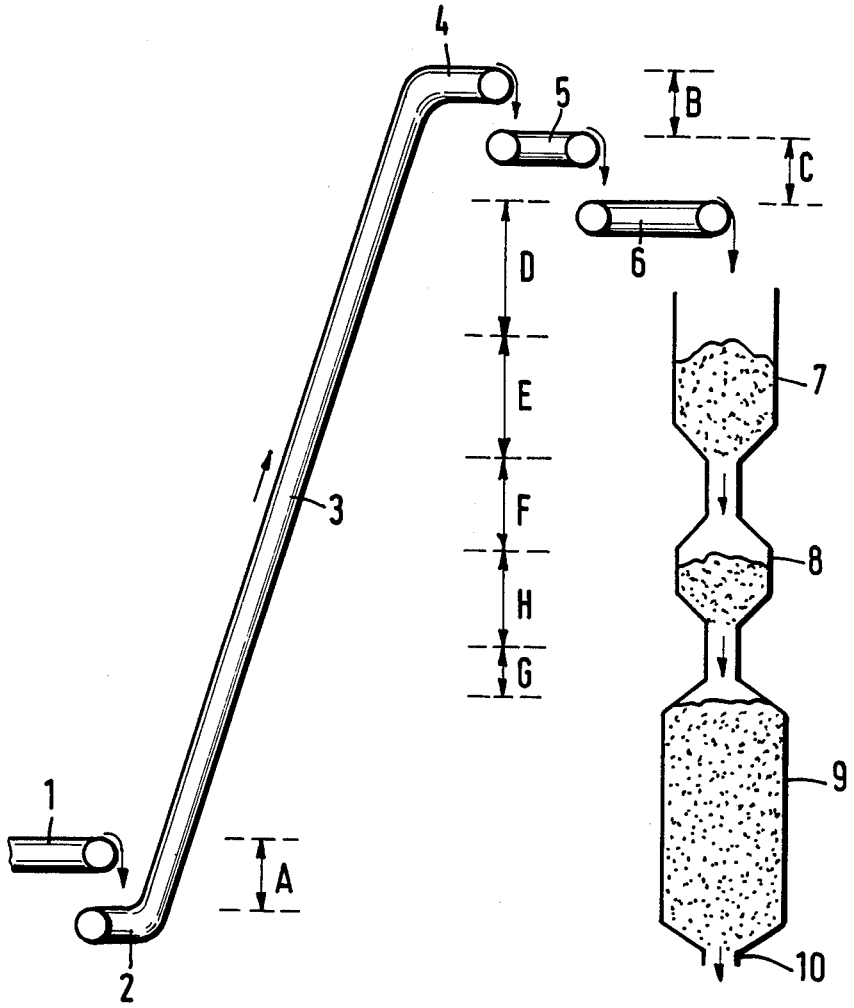
4
5
B
C
6
D
E
F
H
G
7
8
9
10
3
1
A
2

FIXED BED GASIFICATION PROCESS

This is a continuation of application Ser. No. 943,893, filed Dec. 17, 1986, now abandoned, which is a divisional of Ser. No. 795,387, filed Nov. 6, 1985, now abandoned.

BACKGROUND OF THE INVENTION

This invention relates to a process of making coal-containing pellets for gasification in a reactor under pressures in the range from 5 to 150 bars by means of oxygen, steam and/or carbon dioxide as gasifying agents in a process in which the pellets are fed in the reactor to the top of a gradually descending fixed bed, the gasifying agents are introduced into said fixed bed from below, and the mineral constituents are withdrawn as solid ash or liquid slag from the bottom of the fixed bed.

Such process is known from European Patent No. 10792. The gasification of granular coal in a fixed bed is explained, e.g., in Ullmanns Enzyklopadie der technischen Chemie, 4th edition (1977), Vol. 14, on pages 383 to 386. Details of the gasification process in which the acid remains solid are apparent from U.S. Pat. Nos. 3,540,867 and 3,854,895 and Published German Application No. 2,201,278.

The modified process in which liquid slag is withdrawn has been explained in British Patent Specification Nos. 1,507,905; 1,508,671 and 1,512,677. In said known processes a granular fuel having particle sizes in the range from about 3 mm to about 60 mm is supplied to the gasification reactor.

SUMMARY OF THE INVENTION

It is an object of the invention to provide a simple process of making coal-containing pellets, which can be gasified alone or together with granular fuel in a fixed bed. It is important that such pellets do not disintegrate as they are transported to the gasification reactor even when they must be transported over a long distance. Besides, the pellets should exhibit a good gasification behavior in the reactor and should not give rise to disturbances in the gasification process. In the process which has been described first hereinbefore this is accomplished in accordance with the invention in that only fine-grained hard coal having particle sizes below 1 mm and containing 3 to 10 wt. % fines having particle sizes not in excess of 2 Mm, and 70 to 80 wt. % of fines not in excess of 63 Mm is used, the fine-grained hard coal is mixed with bentonite to provide a mixture containing 1 to 8 wt %. bentonite, pellets having a water content of 15 to 25 wt. % are formed from the mixture and added water, and the pellets are fed to the fixed bed in a moist, undried, state, in which they are plastically deformable.

The abbreviation "Mm" herein means micrometer or $10^{-6}$ meter. Any particle size fraction for which only an upper size limit is stated has as its lower limit the (theoretical) particle size zero.

The coals which can be used to make the pellets are hard coals of Classes 0 to 9 in accordance with DIN 23 003 or corresponding coals of the classes from "high volatile C-bituminous" to "anthracite" in accordance with ASTM. The use of fine-grained hard coal having particle sizes below 0.35 mm is preferred.

Suitable binders include the various bentonites, such as natural sodium bentonites, activated calcium bentonites as well as high-bentonites, activated calcium bentonites as well as high-bentonite raw clays. The bentonite binder may be fed together with the coal to a grinding plate or may be added to the ground hard coal in a mixer. In a preferred practice the coal and the bentonite and optionally also an added flux are jointly subjected to a grinding process because this will result in a highly homogeneous dispersion of the binder. The use of a fine-grained flux, particularly lime, may be suitable if a decrease of the melting point of the coal ash is desired. In that case the mixture to be pelletized contains 2 to 15 wt. % flux.

Some water is suitably added as the fine-grained hard coal is mixed with bentonite so that a raising of dust will be avoided. In that case the bentonite can take up water and swell.

Pellets may be formed from the mixture of hard coal and bentonite on known pelletizing discs with the aid of water as a pelletizing liquid. The pelletizing disc may be replaced, e.g., by a rotary kiln. The pellets which are made suitably have a diameter in the range from 6 to 25 mm, preferably in the range from 8 to 20 mm. The pellets which have been made suitably have a water content in the range from 15 to 25 wt. %. That water content mainly depends on the composition of the coal rather than on the bentonite. Surprisingly it has been found that such pellets, which are still moist, fully meet the requirements involved in a dust-free mechanical handling in transit, during rehandling and as they are charged into the gasification reactor. Such plastic behavior of the pellets will be achieved only when bentonite is used as a binder but will not be obtained if the coal contains binders consisting of other clay minerals, such as illite-containing filter sludges.

Even a small, possible natural drying of the pellets will result in an appreciable loss in plasticity and a further drying will strongly increase the risk of a breakage of the pellets and of a raising of dust. For this reason the moist pellets should be handled and supplied to the gasification when they have still the same water content as immediately after the pelletization. It has been found in numerous tests that said moist, plastically deformable pellets consisting of fine-grained hard coal and bentonite will sufficiently withstand the thermal stresses encountered in the fixed bed of the gasification reactor. In the upper portion of the fixed bed of the gasification reactor the pellets are partly coked, as is known, and the strong combustion which is typical of the gasification begins only in the hotter atmosphere, which contains more oxygen and is obtained in the fixed bed in a larger depth. During the gasification of the pellets in the gasification reactor their carbon content decreases progressively from the outside to the inside. The progress of that decrease has been closely studied and it has been found that the pellets have an excellent dimensional stability in each stage of the combustion process. These findings have been confirmed in the meantime in the production, handling and gasification of moist pellets.

In a preferred practice, the contents of fines in particle sizes not in excess of 4 Mm amounts to 7 to 15 wt. % and the content of finest particles having sizes not in excess of 2 Mm amounts to 4 to 8 wt. % of the hard coal to be pelletized. It is suitable to use hard coal which contains at least 10 wt. % ash. The ash content of the hard coal preferably lies in the range from 15 to 40 wt. %. Whereas the plastically deformable, moist pellets may be supplied to the fixed-bed gasifier as the only fuel, it is obviously possible to gasify the pellets together with granular coal having particle sizes in the range from 3 mm to 60 mm.

BRIEF DESCRIPTION OF THE DRAWING

The FIGURE shows a test apparatus for pellets made in accordance with the invention.

DETAILED DESCRIPTION OF THE INVENTION

In the examples which will be described hereinafter rehandling test will be mentioned, to which the pellets are subjected in order to test their stability in transit and when they are dropped several times from different elevations. That test, which simulates the manner in which the pellets are handled in practice, will be explained with reference to the FIGURE. The pellets are first conveyed on a first conveyor belt 1 to the lower end 2 of an inclined conveyor belt 3. The height of fall A amounts to 1.5 m. From the top end 4 of the inclined conveyor belt 3 the pellets fall over a height B amounting to 2.5 m onto a second conveyor belt 5 and from the latter over a height C of 2 m onto a third conveyor belt 6. The height of fall D from the conveyor belt 6 to the bin 7 amounts to 6 m. Thereafter the pellets descent in a bin 7 in a bed over a height of about 6 m and then fall over a height F of 3.5 m into a lock chamber 8. The bed in the lock chamber 8 has a height H of 3 m. From the lower end of the lock chamber 8 the pellets fall over a height G of 1 m onto the bed in the reactor 9. The pellets are subsequently examined as they leave the reactor 9 at its lower end 10.

EXAMPLE 1

An only slightly caking German non-flaming gas coal in the form of a dried filter sludge (ash content 31 wt. %, moisture content 2.5 wt. %, free swelling index=1) is ground to particle sizes below 0.5 mm and is mixed with 40 grams bentonite per kg coal (on a dry basis). The mixture is adjusted to a water content of about 12 wt. %. The filter sludge contains 7 wt. % of particles not in excess of 2 Mm, 12 wt. % of particles up to 4 Mm, and 78 wt. % of particles not in excess of 63 Mm. On a pelletizing disc, the mixture while being sprayed with water is shaped to form pellets which are 8 to 16 mm in diameter and have a moisture content of 17.9 wt. %. The pellets used for the further investigations have diameters in the range from 12.5 to 16 mm and breaking strengths in the range from 25 to 32 N. The pellets are subjected to the described rehandling test. This results in a formation of less than 0.1 wt. % abraded fines below 1 mm.

The pellets are hardly changed and do not stick together when they are transported over a distance of 480 km in an upright barrel having a height of 200 cm in a covered railroad car. After that transportation the pellets do not stick together and can easily be poured and do not contain abraded fines. 24,000 kg of said moist pellets are gasified under a pressure of 25 bars and by means of a mixture of oxygen and steam as gasifying agents in a gasification reactor, in which the fixed bed formed by the fuel to be gasified has a height of 4.5 m and a diameter of 1.5 m. That gasification proceeds satisfactorily and corresponds to the gasification of granular coal. During the gasification of the pellets the ash can be withdrawn from the reactor just as during the gasification of granular coal.

EXAMPLE 2

A non-caking young gas coal from South Africa, containing 22 wt. % ash and 5.3 % moisture, is ground to have a particle size below 0.315 mm. The ground coal containing 4 wt. % of particles not in excess of 2 Mm, 10 wt. % of particles not in excess of 4 Mm, and 71 wt. % of particles not in excess of 63 Mm. That ground coal is mixed with 50 grams bentonite per kg of coal (on a dry basis) and is subsequently moistened with water. The resulting mixture is supplied to a pelletizing disc and is shaped thereon with an addition of water to form pellets. The resulting pellets had a moisture content of 21.4 wt. %, a diameter of 12.5 to 16 mm and an average strength of 35 N. The pellets are subjected to the described rehandling test. This resulted in a formation of only 0.9 wt. % abraded fines having a particle size below 1 mm.

In order to test the gasification behavior of the moist pellets in the fixed bed, one part of the pellets is dried in a purging gas stream at a temperature of 150° C. As a result, the pellets obtained a strength of 60 to 80 N. A subsequent coking treatment under conditions which are typical for the gasification in the fixed bed has also shown that the pellets do not disintegrate but with a breaking strength of 50 to 60 N have a satisfactory resistance to pyrolysis.

50,000 kg of the undried, moist pellets are gasified under a pressure of 25 bars in the gasification reactor which has been used also in Example 1. The gasification proceeds without a disturbance. The ash can be removed satisfactorily and the results of the gasification corresponds to the gasification of granular coal.

Before their gasification, the moist pellets were transported over a distance of 250 km in a railroad car for bulk material. The unloading of the pellets into an underground bin provided with a clearing arm and the subsequent transport by means of rubber conveyor belts, a sieving machine, a bucket elevator and a scraper conveyor belt give rise to no problems and do not result in any raising of dust. Fines below 3 mm are formed in relatively small amounts and substantially only adjacent to the clearing arm in the underground bin. The transport of the pellets over a long distance from the bin via the weighing tank, the lock chamber are the coal distributor onto the fixed bed of the gasification reactor are performed without difficulty and do not result in an abrasion.

EXAMPLE 3

A non-caking lean coal which contains 25 wt. % ash and 1.8 wt. % moisture is ground to a particle size below 0.315 mm and is intensively mixed with 40 g bentonite per kg of coal (on a dry basis). The ground coal contains 6 wt. % of a particle size fraction not in excess of 2 Mm, 1 wt. % of a fraction not in excess of 4 Mm and 74 wt. % of a fraction not in excess of 63 Mm. The mixture is moistened and pellets which are 8 to 20 mm in diameter are made with a further addition of water on a pelletizing disc. The pellets contain 18.7 wt. % moisture. The pellets used for the further investigations have diameters in the range from 12.5 to 16 mm. They have an average breaking strength of about 22 N. 400 kg of said pellets are subjected to the rehandling test, which results against only in a very small amount of abraded fines below 1 mm.

In order to test their behavior during the gasification in the fixed bed, the pellets were first dried. As a result, they had an average breaking strength of 70 N. The strength properties of the pellets were virtually not changed when they coked under a pressure of 25 bars. This shows that they ar entirely suitable as a feedstock for the gasification in a fixed bed.

EXAMPLE 4

An only slightly caking long-flaming gas coal from Great Britain, which contains 3.7 wt. % ash and 7.3 wt. % moisture and had a free swelling index of 1, is ground to a particle size below 0.315 mm. This example is performed to determine the influence of the content of finest particles of the properties of the pellets. The ground coal contains 60 wt. % of a particle size fraction not in excess of 63 Mm, only 1.7 wt. % of a fraction not in excess of 2 Mm and 3.9 wt. % of a fraction not in excess of 4 Mm. That ground coal is mixed with 6 wt. % bentonite. Water-containing pellets which contained 29 wt. % moisture were made from the mixture in the manner described in Example 1. The pellets have a strength of less than 10 N. They are not plastically deformable and very brittle, like partly dried pellets. Even small tensile or shear stresses result in a disintegration of the pellets.

A fractional part of the long-flaming gas coal was reground and was then admixed to the previously ground coal to increase the content of particles not in excess of 2 Mm to 4.8 wt. %, the content of particles not in excess of 4 Mm to 10 wt. % and the content of particles not in excess of 64 Mm to 72 wt. %. The fine coal having that particle size distribution of 6 wt. % bentonite are used to make pellets in the manner described hereinbefore. The resulting pellets have a moisture content of 25.9 wt. % and an average strength of now 25 N. The pellets have a denser structure and are plastically deformable. The rehandling test results in a formation of 0.1 wt. % abraded fines below 1 mm.

The plastically deformable pellets are dried and are coked under a pressure of 25 bars. As a result, they obtain a strength of about 720 N. The drying and coking of the brittle pellets described above results only in strengths of about 70 N. A charge of 100,000 kg of the plastically deformable, moist pellets is gasified without difficulty under a pressure of 25 bars and with a mixture of stream and oxygen in a gasification reactor in which the ash is discharged in liquid form. If the plastically deformable, moist pellets are made with an addition of 3 wt. % limestone, the melting temperature of the ash in the gasification reactor can be decreased by about 70° C.

In other experiments, the plastically deformable, moist pellets are transported in barrels over a distance of more than 1000 km and subsequently charged into a bin. This does not involve a raising of dust and a formation of abraded fines. Finally, no complications are encountered when the pellets are removed from the bin and charged into the gasification reactor through a lock chamber and over a coal distributor.

EXAMPLE 5

A non-caking anthracitic coal containing 11 wt. % ash and 1.8% moisture is ground in known manner. The contents of finest particles in the ground coal are lower than is usual in other high-ash hard coals. The coal contains 6 wt. % of the particle size fraction not in excess of 4 Mm, 2.1 wt. % of a particle size fraction not in excess of 2 Mm and 68 wt. % of a particle size fraction not in excess of 63 wt. % of a particle size fraction not in excess of 63 Mm. Moist pellets containing 4 wt. % bentonite as a binder are made as in Example 2. The pellets contain 21 wt. % water and have an average breaking strength of 17 N. The pellets are not plastically deformable and break when dripped from a large height. Even small tensile and shear tresses result in a disintegration. The pellets behave like initially dried pellets.

A larger particle size range is obtained in that the coal is enriched with finest particles. As a result, the particle size fraction not in excess of 4 Mm can be increased to 9.3 wt. %, the fraction not in excess of 2 Mm to 3.6 wt. % and the fraction not in excess of 63 Mm to 17 wt. %. As in Example 2, pellets which have a diameter of 12.5 to 16 mm and a moisture content of 19.2 wt. % are made from that coal with an addition of 4 wt. % bentonite. The pellets have an average breaking strength of 19N. They exhibit distinct plastic properties and have a denser structure so that they are entirely suitable for transportation. A subsequent convective drying for testing the behavior in the upper portion of a fixed bed in a gasifier indicates that the pellets have average breaking strength of 90 to 100 N. Drying is effected at 150° C. A low-temperature distillation of the pellets under the conditions found in a gasification reactor results in coke pellets having a strength of 60 N. This shows that the plastically deformable pellets are suitable in every respect as a feedstock for the gasification reactor.

It will be appreciated that the instant specification and claims are set forth by way of illustration and not limitation, and that various modifications and changes may be made without departing from the spirit and scope of the present invention.

What is claimed is:

1. A process for gasifying moist, undried, plastically deformable coal-containing pellets wherein said process is carried out in a gasification reactor under pressures in the range from 5 to 150 bars by means of oxygen, steam and/or carbon dioxide as gasifying agents comprising feeding said pellets into the reactor onto the top of a gradually descending fixed bed, introducing the gasifying agents into said fixed bed from below, and withdrawing mineral constituents of the coal-containing pellets as solid ash or liquid slag from the bottom of the fixed bed, and wherein said moist, undried plastically deformable coal-containing pellets are prepared by mixing only fine-grained hard coal having particle sizes not in excess of 0.35 mm and containing 3 to 10 wt. % fines having particle sizes not in excess of 2 micrometers and 70 to 80 wt. % of fines not in excess of 63 micrometers with bentonite to provide a mixture containing 1 to 8 wt. % bentonite, adding water and forming pellets on a pelletizing disc, said pellets having a water content of 15 to 25 wt. % and diameters in the range of from 6 to 25 mm.

2. A process according to claim 1, wherein the fine-grained hard coal contains 7 to 18 wt. % of fine particles not in excess of 4 micrometers.

3. A process according to claim 1, wherein the fine-grained hard coal contains 4 to 8 wt. % of fines not in excess of 2 micrometers.

4. A process according to claim 1, wherein the hard coal contains at least 10 wt. % ash.

5. A process according to claim 4, wherein the hard coal contains 15 to 40 wt. % ash.

6. A process according to claim 1, wherein the mixture to be pelletized contains a fine-grained flux in an amount of 2 to 15 wt. %, in order to reduce the melting temperature of the ash.

7. A process according to claim 6, wherein said fine-grained flux is lime.

8. A process according to claim 1, wherein the pellets are fed to the fixed bed together with fine-grained coal having particle sizes in the range from 3 to 60 mm.

* * * * *